United States Patent [19]

Glenn

[11] 4,142,836

[45] Mar. 6, 1979

[54] MULTIPLE-PIECE CERAMIC TURBINE BLADE

[75] Inventor: Robert G. Glenn, Huntingdon Valley, Pa.

[73] Assignee: Electric Power Research Institute, Inc., Palo Alto, Calif.

[21] Appl. No.: 755,120

[22] Filed: Dec. 27, 1976

[51] Int. Cl.[2] ..... F01D 5/30

[52] U.S. Cl. ..... 416/193 A; 416/219 R; 416/212 A; 416/241 B; 416/248

[58] Field of Search ..... 416/219–221, 416/241 B, 248, 193 A, 212 A

[56] References Cited

U.S. PATENT DOCUMENTS

| | | | |
|---|---|---|---|
| 2,715,011 | 8/1955 | Schörner | 416/223 A X |
| 2,781,998 | 2/1957 | Barr | 416/220 |
| 2,836,392 | 5/1958 | Spaeth | 416/219 X |
| 2,873,947 | 2/1959 | Perry | 416/220 |
| 3,002,675 | 10/1961 | Howell et al. | 416/219 X |
| 3,702,222 | 11/1972 | Bernales | 416/219 X |
| 4,093,399 | 6/1978 | Glenn | 416/95 |

FOREIGN PATENT DOCUMENTS

| | | | |
|---|---|---|---|
| 826332 | 12/1951 | Fed. Rep. of Germany | 416/214 A |
| 189131 | 3/1923 | United Kingdom | 416/212 A |
| 740757 | 11/1955 | United Kingdom | 416/248 |

*Primary Examiner*—Everette A. Powell, Jr.
*Attorney, Agent, or Firm*—Townsend and Townsend

[57] ABSTRACT

A turbine blade comprised of at least a pair of abutting blade parts with each part having a root coupled to an attachment piece, the latter adapted to be coupled to a turbine rotor. The blade parts can be curved and each blade part may have a hollow space in the region where it abuts the other blade part to reduce the weight of the blade. The blade parts may be spigoted or mated with tongue and groove structure to reduce fluid leakage through the junction between the blade parts.

7 Claims, 7 Drawing Figures

FIG. 2
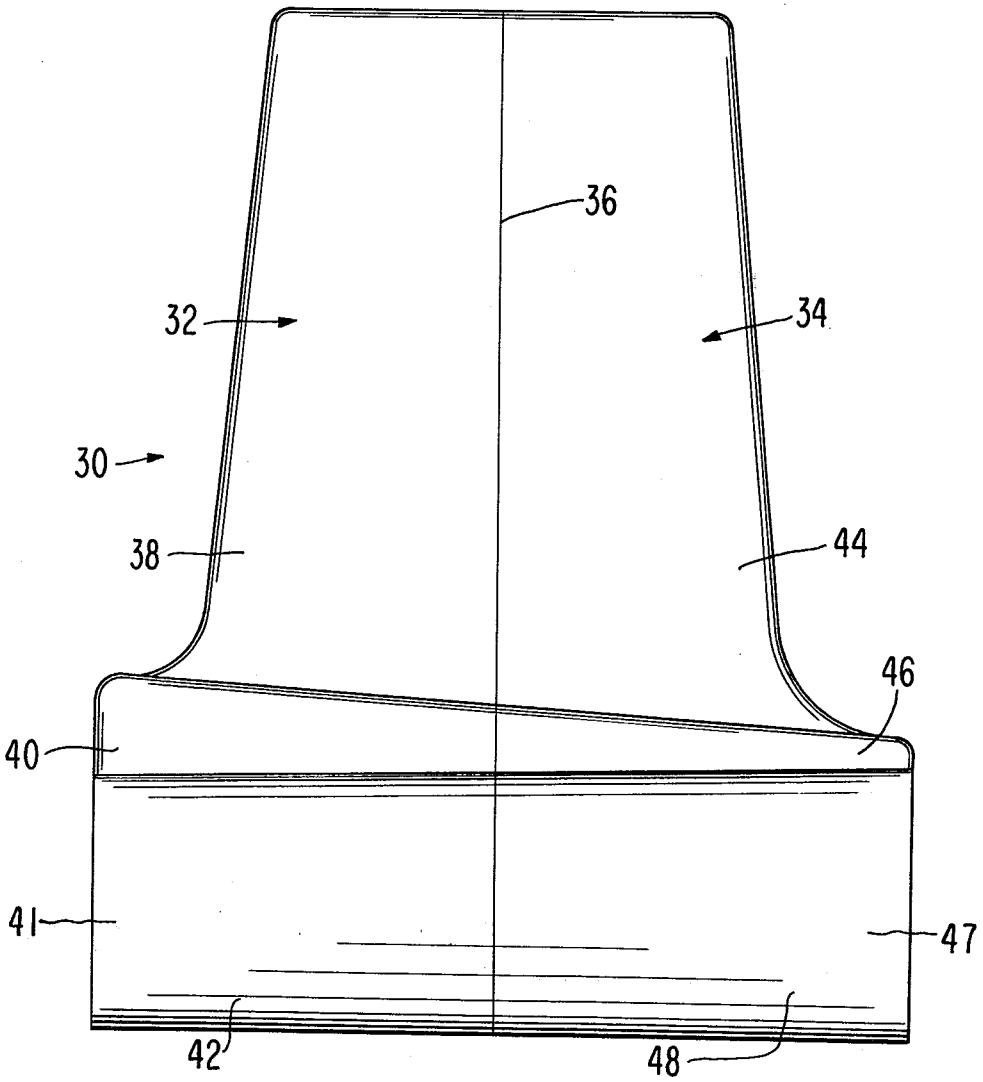
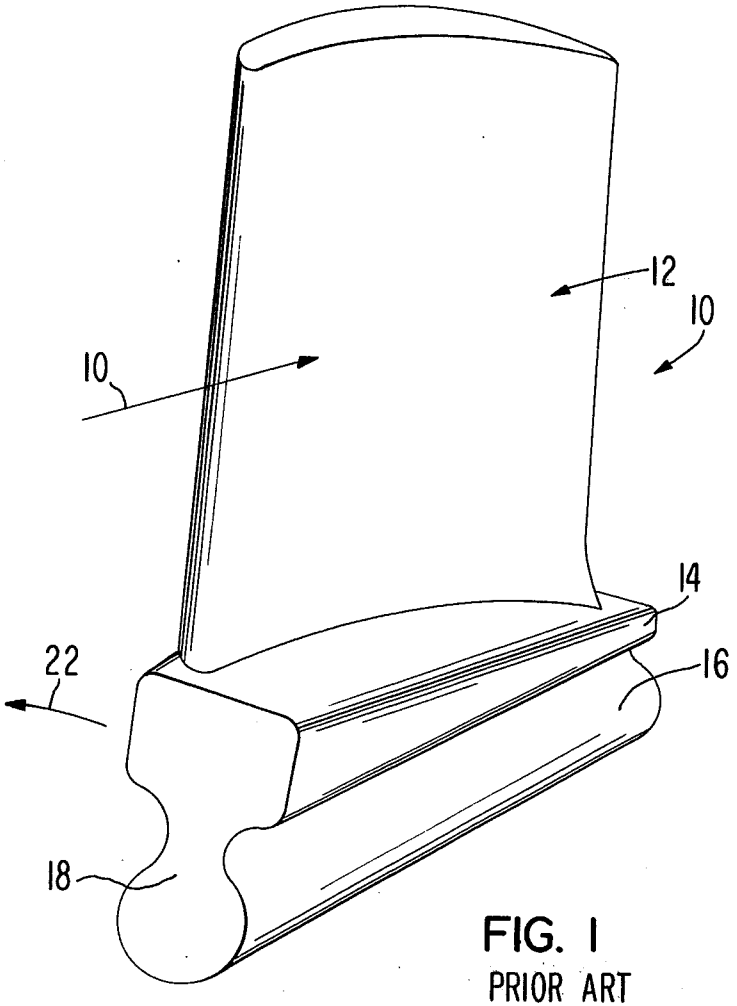
FIG. 1
PRIOR ART

FIG. 3
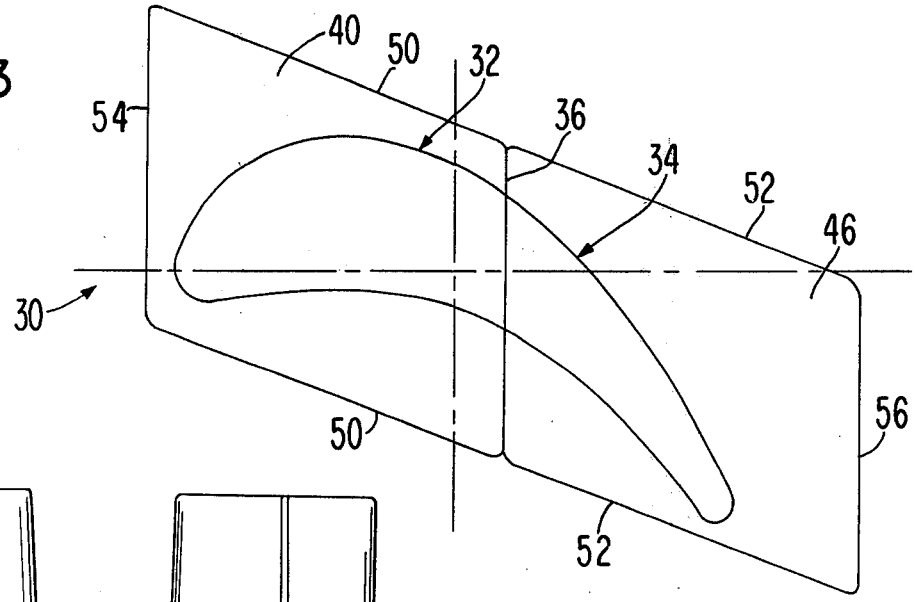
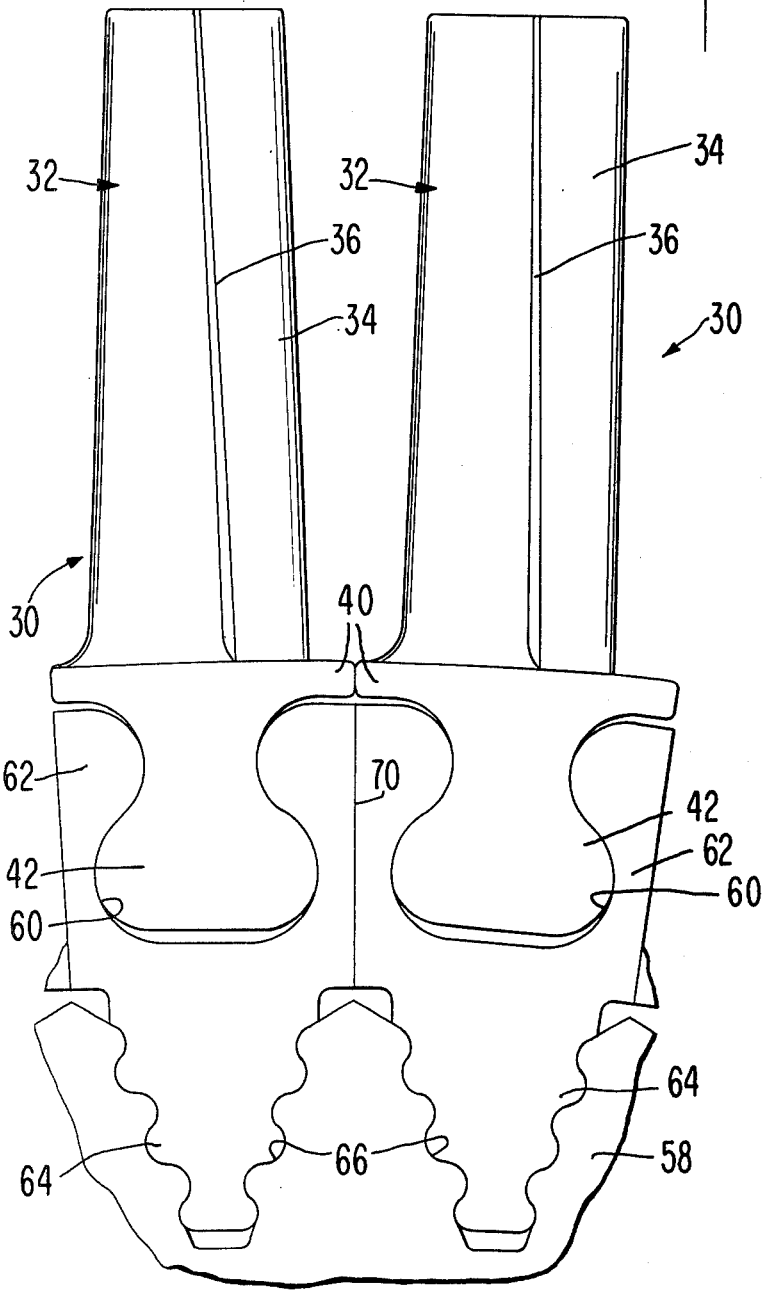
FIG. 4

MULTIPLE-PIECE CERAMIC TURBINE BLADE

This invention was made under contract with or supported by the Electric Power Research Institute, Inc.

This invention relates to gas turbine engines and, more particularly, to improvements in the blades of the rotor of such an engine.

BACKGROUND OF THE INVENTION

The efficiency of gas turbine engine may be improved by raising the turbine gas inlet temperature. In the present state of the art, this temperature is limited because both the blades and the rotor disk of the turbine rotor are metallic and cannot withstand the gas temperatures above certain maximum values. Ceramic materials are currently under investigation for use in making turbine blades. One of the properties of ceramic material is its very low heat transfer. This results in high thermal gradients within the parts of the turbine rotor when ceramic blades are used. A full sized blade, i.e., one having a chord of about 4.0 inches, in the first stage of a typical gas turbine engine would crack due to bowing along the chord length at the root of the blade. The bowing would be caused by the temperature gradient from that area of the blade exposed to the hot gas flow to the blade area buried within the rotor disk or intermediate attachment piece connecting the blade to the disk.

One solution that has been proposed is to reduce the blade section by 50%, thereby reducing its chord accordingly while maintaining the original blade height. This results in a blade section which is much thinner relative to the length, a problem which is not desirable. The obvious disadvantage is that, with such a smaller blade section, the effect is to double the tolerances of the blade unless the tolerances are also reduced by 50%. This approach is, therefore, impractical.

In view of the foregoing problem, a need has arisen for an improved turbine blade to compensate for bowing in the base of the blade while maintaining a full sized blade section.

SUMMARY OF THE INVENTION

The present invention satisfies the foregoing need by providing an improved turbine blade which is made up of at least two adjacent, abutting parts, both of which are coupled to the turbine rotor by an attachment piece. Thus, the tolerances of the blade are effectively reduced by at least 50% since the blade is divided into at least two parts. Moreover, by dividing the blade into two parts, the temperature gradient, which is the normal cause for cracks in the root of a ceramic motor blade, is effectively reduced, but each of the blade parts has a chord length under a critical value above which cracking would ordinarily occur when the temperature operates at typical gas inlet temperatures.

The two parts of the blade of the present invention are secured to a rotor disk by an attachment piece which also isolates the rotor disk from the inlet gas temperatures of the turbine. Each blade part may be at least partially hollow in the region where it abuts the adjacent blade part so that the weight of the blade made up of the two parts is effectively reduced. The blade parts may be spigoted or mated with tongue and groove structure to prevent fluid leakage at the junction between the blade parts. This assures that the resulting blade has the advantages of a full sized, integral blade yet results in a blade which, although made up of two parts, is simple and rugged in construction. The present invention would also allow a blade of any chord length to be made out of ceramic by making the blade in the number of parts that would maintain a proper chord length.

The primary object of this invention is to provide an improved turbine blade of ceramic material wherein the blade is formed of at least two abutting parts to reduce the tolerances of the blade by 50% so that it can withstand temperature gradients more effectively without cracking than is capable with an integral blade of the same size as the combined two blade parts forming the blade of the present invention.

Another object of this invention is to provide a blade of the type described wherein the blade parts have roots which can be coupled to a rotor disk by a single attachment piece to avoid additional structure to mount the blade parts yet provide a blade which functions in the same manner as an integral blade except for the reduction in the tolerances mentioned above.

Other objects of this invention will become apparent as the following specification progresses, reference being had to the accompanying drawings for an illustration of several embodiments of the blade of this invention.

IN THE DRAWINGS

FIG. 1 is a perspective view of the ceramic turbine blade of the prior art;

FIG. 2 is a side elevational view of the multiple-piece ceramic turbine blade of the present invention;

FIG. 3 is a top plan view of the blade of FIG. 2;

FIG. 4 is an end elevational view of a pair of blades of the type shown in FIG. 2;

Figure 7:
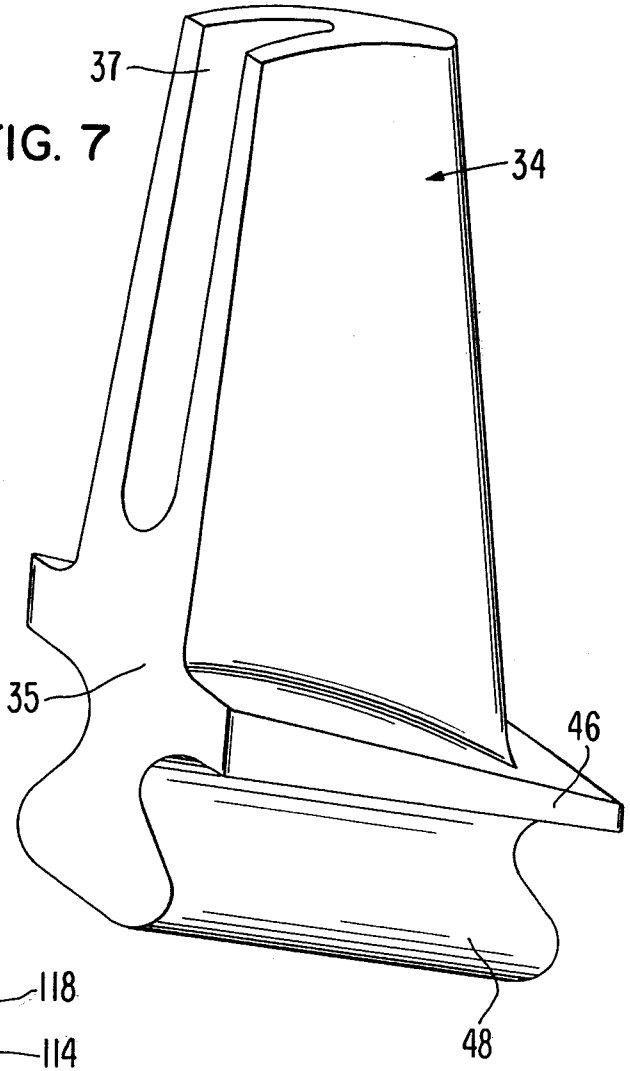
FIG. 7 is a perspective view of one of the parts of the blade of this invention, showing the way in which it can be hollowed out to reduce the weight of the blade.

Blade 10, as shown in FIG. 1, is a typical prior art integral ceramic turbine blade. It has an upper blade portion 12 provided with a base 14, the latter having a root 16 integral therewith by way of a connecting neck 18. The critical area for damage to mechanical and thermal stresses on blade 10 is at neck 18. Hot gases flow in the direction of arrow 20, and the direction of rotation of blade 10 is indicated by the numeral 22. Root 16 is attached to a rotor disk by way of an attachment piece (not shown), the attachment piece being normally made of high-temperature metal and being cooled, if desired. The attachment piece thermally isolates the rotor disk from the region of the high temperature gases directed onto blade portion 12.

Blade portion 12 is normally bowed along its chord length. The cracking along the chord length is normally due to the temperature gradient between blade portion 12 and root 16 since ceramic material has very low heat transfer characteristics. This elimination of cracking due to thermal gradients is the purpose for which the present invention has been developed.

The first embodiment of the blade of this invention is broadly denoted by the numeral 30 and is shown in FIGS. 2 and 3. Blade 30, for purposes of illustration, includes a pair of blade parts 32 and 34 which abut each other along a junction 36 therebetween. The blade can be formed of more than two parts, if desired or deemed necessary.

Blade part 32 has a base 40, a neck 41 integral with base 40, and a root 42 integral with neck 41. Similarly, blade part 34 abuts and is coextensive with blade part 32 and has an integral base 46 coextensive with base 40, a neck 47 integral with base 46, and a root 48 integral with neck 47 and coextensive with root 42. Blade parts 32 and 34 can be curved as shown in FIG. 3 so that bases 40 and 46 have angled sides 50 and 52 (FIG. 3). The ends 54 and 56 of bases 40 and 46 are parallel with each other and with the junction 36 therebetween.

FIG. 4 shows the way in which a pair of blades 30 are coupled to a rotor disk 58, the latter being shown only fragmentarily. To this end, the roots 42 and 48 and necks 41 and 47 of blade parts 32 and 34 of each blade 30 are received within a corresponding groove 60 in an attachment piece 62 of high temperature metal and of the type having a fir tree root 64 receivable within a corresponding groove 66 in rotor disk 58. Each pair of adjacent attachment pieces 62 abut each other along a junction 70 therebetween, and adjacent bases 40 and 46 (FIG. 4) of each pair of adjacent blades 30 also abut each other. Thus, rotor disk 58 is effectively isolated from the high temperatures of the gases which strike blade parts 32 and 34 of the various blades 30. As shown in FIGS. 2 and 4, roots 42 and 48 extend axially of the axis of rotor disk 58.

Figure 5:
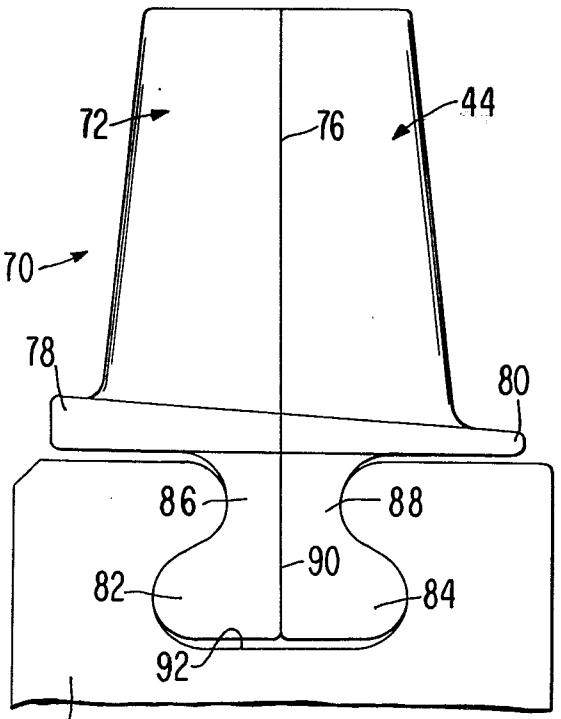
FIG. 5 is a view similar to FIG. 1 but showing a second type of multiple-part ceramic turbine blade having a root different from that shown in FIG. 2.

FIG. 5 illustrates another form of the blade of this invention, the blade being denoted by the numeral 70 and formed of blade parts 72 and 74 which are in substantial abutment along a junction 76 therebetween. Blade parts 72 and 74 have bases 78 and 80 and are provided with roots 82 and 84 connected in integral fashion by necks 86 and 88, respectively, to respective bases 78 and 80. The roots and necks abut each other along a junction 90 coextensive with junction 76 and are received within a single groove 92 in an attachment piece 94, the latter adapted to be coupled to the outer periphery of a rotor disk (not shown). Groove 92 thereby extends transversely to the axis of the rotor disk to which attachment piece 94 is coupled. Blade parts 72 and 74 can be curved chords in the manner shown above with respect to blade 30 in FIG. 3. The length of roots 82 and 84 are such as to permit adjacent attachment pieces 94 to abut each other in the manner shown in FIG. 4 with respect to attachment pieces 62.

Figure 6:
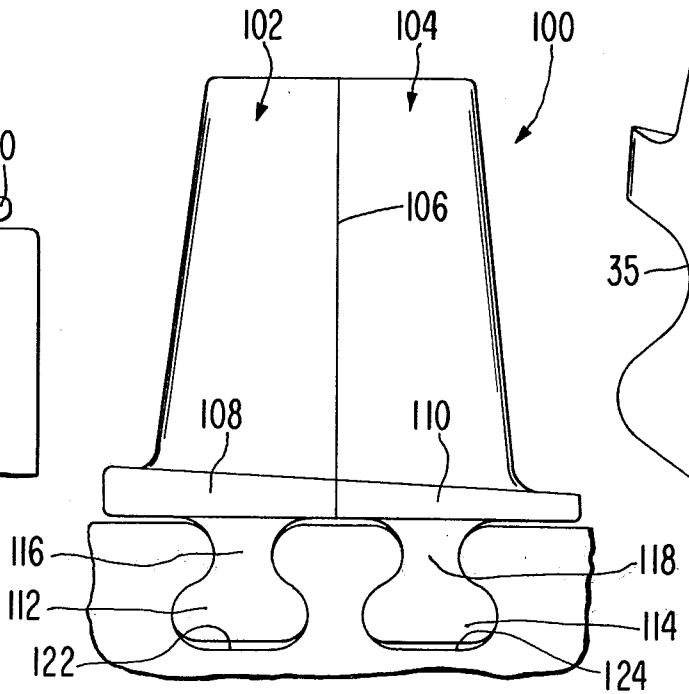
FIG. 6 is a view similar to FIGS. 2 and 5 but showing a third embodiment of the blade of this invention.

FIG. 6 illustrates a blade 100 formed of blade parts 102 and 104 abutting each other along a common junction 106. Blade parts 102 and 104 have bases 108 and 110 having roots 112 and 114 coupled in integral fashion by necks 116 and 118, respectively, to respective bases 108 and 110. Instead of a single groove as shown in FIG. 5, the attachment piece 120 has a pair of grooves 122 and 124 extending transversely to the longitudinal axis of the corresponding rotor disk for receiving roots 112 and 114 and necks 116 and 118. Since grooves 122 and 124 are spaced apart, roots 112 and 114 are also spaced apart in contrast to the abutting roots of the embodiment of FIG. 5.

In FIG. 7, a blade part, for instance blade part 34, is shown. It has a flat face 35 for abutment at junction 36 (FIGS. 2, 3 and 4) with a corresponding flat face on blade part 34. FIG. 7 also illustrates a space 37 where blade material has been removed, the space being transversely U-shaped for purposes of illustration. By removing the material in space 37, the weight of blade 30 is reduced. Similarly, the corresponding blade part 32 can have a space similar to space 37 formed therein to reduce its weight as well. The reduction in the weight of the blade results in a reduction of the mechanical stress at the base of the blade and at the root.

The blade parts of the various embodiments may be spigoted or mated with tongue and groove structure at the junction between adjacent parts to substantially eliminate fluid leadkage through the junction. Moreover, this feature maintains the advantage of a full sized blade and results in a blade of a rugged construction even though the blade is made up of two or more parts.

I claim:

1. In a gas turbine engine: a turbine rotor disk having an outer periphery; a plurality of turbine blades; and an intermediate attachment piece for each blade, respectively, the attachment pieces being coupled to the rotor disk and extending outwardly therefrom, each of said turbine blades including a pair of abutting blade parts generally coextensive with each other, each blade part having a base integral therewith and a root integral with the base, each intermediate attachment piece having an outer peripheral groove receiving the root of a respective blade part, the bases of the blade parts of each blade being in longitudinal alignment with each other, extending fore and aft of the disk at an angle relative to the axis of the disk, and being in abuttment with the bases of blade parts of the adjacent blades.

2. In a turbine engine as set forth in claim 1, wherein the roots and bases of the blade parts extend longitudinally of the axis of the rotor disk and are in substantial abutment with each other.

3. In a turbine engine as set forth in claim 1, wherein the roots of the blade parts extend transversely of the longitudinal axis of the rotor disk and are in substantial abutment with each other along a line coextensive with the junction between the blade parts.

4. In a turbine engine as set forth in claim 1, wherein the roots of the blade parts extend transversely of the rotor disk axis and are spaced from each other with reference to the axis of said rotor disk.

5. In a turbine engine as set forth in claim 1, wherein at least one of the two parts of each blade has a hollow space adjacent to the junction of the blade parts to reduce the weight of the blade.

6. In a turbine engine as set forth in claim 1, wherein the junction between the two blade parts is spigoted.

7. In a turbine engine as set forth in claim 1, wherein the blade parts of each blade have tongue and groove structure at the junction therebetween to substantially eliminate the flow of gases through the junction.

* * * * *